US010563417B2

(12) United States Patent
Díclelí et al.

(10) Patent No.: US 10,563,417 B2
(45) Date of Patent: Feb. 18, 2020

(54) TORSIONAL HYSTERETIC DAMPER

(71) Applicants: Murat Díclelí, Ankara (TR); Ali Salem Milani, Ankara (TR)

(72) Inventors: Murat Díclelí, Ankara (TR); Ali Salem Milani, Ankara (TR)

( * ) Notice: Subject to any disclaimer, the term of this patent is extended or adjusted under 35 U.S.C. 154(b) by 0 days.

(21) Appl. No.: 16/307,493

(22) PCT Filed: Jun. 7, 2017

(86) PCT No.: PCT/TR2017/050253
§ 371 (c)(1),
(2) Date: Dec. 6, 2018

(87) PCT Pub. No.: WO2018/056933
PCT Pub. Date: Mar. 29, 2018

(65) Prior Publication Data

US 2019/0257107 A1 Aug. 22, 2019

(30) Foreign Application Priority Data

Jun. 8, 2016 (TR) ..... 2016/07751

(51) Int. Cl.
*E04H 9/02* (2006.01)

(52) U.S. Cl.
CPC ..... *E04H 9/021* (2013.01); *E04H 9/024* (2013.01)

(58) Field of Classification Search
CPC ..... E04H 1/98; E04H 2009/026; E04H 9/021; E04H 9/024; E04B 1/98; E04B 1/985
USPC ..... 52/167.1, 167.2, 167.3, 167.4, 167.7, 52/167.8
See application file for complete search history.

(56) References Cited

U.S. PATENT DOCUMENTS 5,005,326 A * 4/1991 Ishimaru ..... E04B 1/985 248/562
5,245,807 A * 9/1993 Ishimaru ..... E04B 1/985 248/550
5,533,307 A * 7/1996 Tsai ..... E04H 9/021 52/167.1
5,630,298 A * 5/1997 Tsai ..... E04H 9/021 52/167.1
5,806,250 A * 9/1998 Medeot ..... E04H 9/021 52/167.1
5,842,312 A 12/1998 Krumme et al.
5,875,589 A * 3/1999 Lai ..... E04B 1/98 52/1
6,141,919 A * 11/2000 Robinson ..... F16F 1/40 248/562
6,223,483 B1 * 5/2001 Tsukagoshi ..... E04H 9/02 52/167.1
6,247,275 B1 * 6/2001 Taylor ..... E04H 9/02 52/167.1
7,797,886 B2 * 9/2010 Su ..... E04H 9/02 248/632

(Continued)

FOREIGN PATENT DOCUMENTS

CN 103572856 A 2/2014
JP H03103509 A 4/1991

*Primary Examiner* — Theodore V Adamos
(74) *Attorney, Agent, or Firm* — Gokalp Bayramoglu

(57) ABSTRACT

The present invention provides a torsional hysteretic damper for braced frames. The torsional hysteretic damper is used to reduce displacement and associated damages on structural elements by dampening (dissipating) an earthquake energy that impacts structures.

3 Claims, 9 Drawing Sheets

(56) References Cited

U.S. PATENT DOCUMENTS

| | | | | |
|---|---|---|---|---|
| 9,447,915 | B1 * | 9/2016 | Morgan | F16M 13/02 |
| 9,580,924 | B1 * | 2/2017 | Taylor | E04H 9/028 |
| 9,885,175 | B1 * | 2/2018 | Izumi | E04H 9/021 |
| 2002/0020122 | A1 | 2/2002 | Mueller | |
| 2005/0050810 | A1 * | 3/2005 | Shimazaki | E01D 19/02 52/167.1 |
| 2005/0138870 | A1 * | 6/2005 | Ishimura | E01D 19/00 52/167.1 |
| 2005/0257451 | A1 * | 11/2005 | Pryor | E04B 1/2403 52/167.4 |
| 2008/0295420 | A1 * | 12/2008 | Simmons | E04H 9/02 52/167.3 |
| 2011/0283653 | A1 | 11/2011 | Christopoulos et al. | |
| 2012/0038091 | A1 * | 2/2012 | Tagawa | E04H 9/021 267/136 |
| 2012/0066986 | A1 * | 3/2012 | Dicleli | E04H 9/021 52/167.1 |
| 2012/0138402 | A1 * | 6/2012 | Choi | E04H 9/02 188/381 |
| 2013/0283709 | A1 | 10/2013 | Christopoulos | |
| 2015/0048234 | A1 * | 2/2015 | Almazan Campillay | F16F 15/022 248/568 |
| 2017/0067249 | A1 * | 3/2017 | Matteson | E04B 1/985 |
| 2018/0142489 | A1 * | 5/2018 | Becci | E04B 1/40 |

* cited by examiner

TORSIONAL HYSTERETIC DAMPER

CROSS REFERENCE TO RELATED APPLICATIONS

This application is the national phase entry of International Application No. PCT/TR2017/050253, filed on Jun. 7, 2017, which is based upon and claims priority to Turkish Application No. 2016/07751, filed on Jun. 8, 2016, the entire contents of which are incorporated herein by reference.

TECHNICAL FIELD

The invention subject to the application is related to a torsional hysteretic damper that has been designed for braced frames. The aim of the torsional hysteretic damper is to reduce displacement and the associated damage on structural elements, by dampening (dissipating) earthquake energy that impacts structures.

BACKGROUND

Dampers dampen (dissipate) the kinetic energy that has been loaded on them. If explanation needs to be made in terms of force and displacement instead of energy, it can be said that, the force applied to the structure by the damper between two mounting points of the damper opposes the relative displacement between two mounting points of the device and hence leads to reduced displacement and thus reduced damage in the structure to which it is mounted. This force is referred to as the reaction force of the damper. Damping in hysteretic dampers is obtained by using a metal that will yield, develop plastic strain and act as a hysteretic energy-dissipating element.

Deployment of energy dissipation devices in building frames is a well-known practice. These devices include viscous dampers, hysteretic dampers, friction-based energy dissipaters and buckling-restraint braces (BRB). Among the steel dampers developed for use in braced frames, the most well-known is the added damping and stiffness (ADAS) elements and its variation, triangular-plate added damping and stiffness (TADAS). ADAS is composed of a series of X-shaped plates clamped and fixed at top and bottom through a bolted connection. Full-scale tests have shown advantages of incorporation of ADAS dampers in terms of reduction of damage in primary structural members, reduction of inter-story deformations at minor and moderate level earthquakes and stable hysteretic behavior of the bracing system. E-shaped and C-shaped elements are another type of plate-bending metallic dampers for Chevron-type bracing systems. Round-hole and double X-shaped dampers also belong to this class of dissipating elements. These two dampers also are of plate-bending type. Another type of plate-bending based damper is the Steel Slit Damper, fabricated from a standard structural wide-flange section with a number of slits cut from the web. Bucking-restraint brace (BRB) is another type of energy dissipation element used in braced frames. In a BRB the brace is encased in a mortar-filled steel tube, while being detached from the mortar using some 'un-bonding' agent. The overall assembly is an element in which the inner steel core is free to slide and thus free to deform axially independent of the outer section, while in bending their flexural resistance is added, producing a section stiff in flexure and thus strong against buckling. The subject of the present invention, torsional hysteretic damper, is a mechanical device designed to utilize torsional yielding of cylindrical energy dissipaters (EDs) made of ductile steel to dissipate the imposed energy through seismic movements in a structure. Torsional hysteretic damper converts the translational motion imposed on it at its two connection points into twisting at the energy dissipaters which are designed to yield in torsion and dissipate energy.

SUMMARY

The invention subject to the application is related to a torsional hysteretic damper that has been designed for braced frames. The purpose of the torsional hysteretic damping device is to realize energy dissipation in steel cylindrical energy dissipaters under torsion through converting the translational movement at the mounting points of the device into twisting at the cylindrical energy dissipaters. The energy dissipater must not be bent while the translational motion is converted into twisting, so that the cylindrical energy dissipaters yield smoothly. Lateral supports are provided to prevent the energy dissipaters from bending.

BRIEF DESCRIPTION OF THE DRAWINGS

The figures are described below.

DESCRIPTION OF THE REFERENCE NUMBERS

Figure 1:
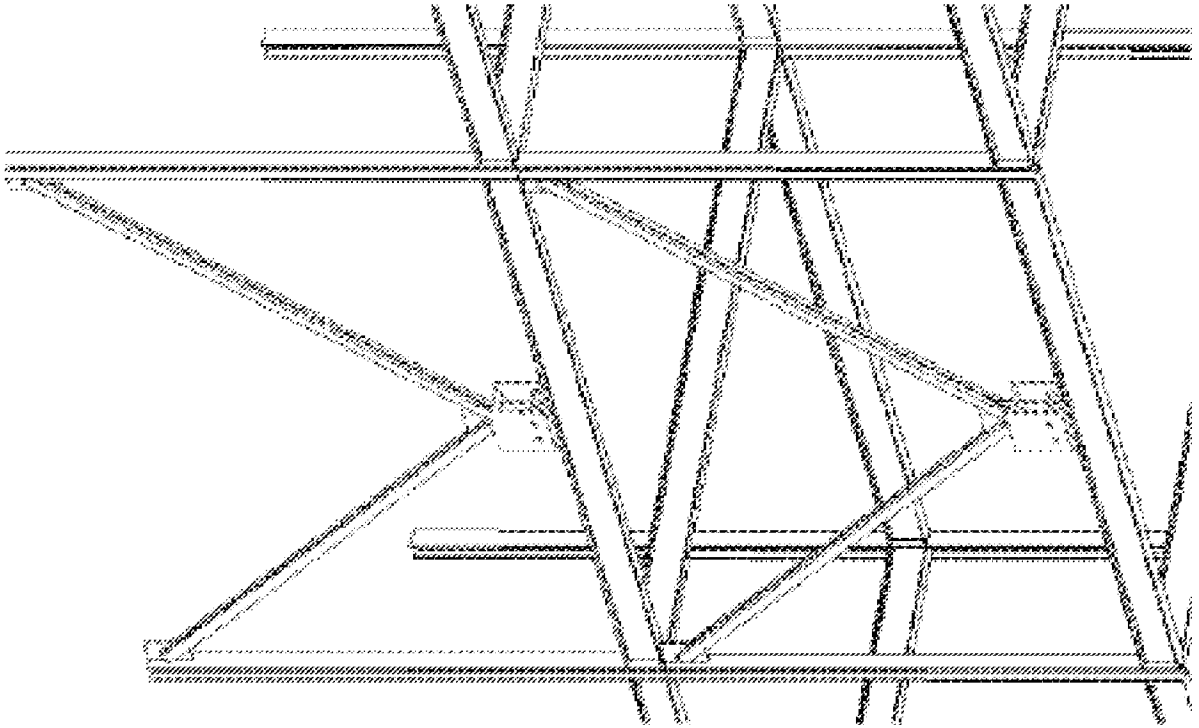
FIG. 1 is a conceptual drawing of the placement of torsional hysteretic dampers on building frames.

The parts in the figures which have been drawn, so as to better explain the torsional hysteretic damper designed for braced frames developed with this invention have each been numbered and the references of each number have been explained below.

1. Cylindrical energy dissipater
2. Torsion arm
3. Support plate
4. Torsional restraint plate
5. Rail
6. Slider block
7. Cylindrical mounting shaft
8. Base plate
9. Connection plate
10. Cover plate
11. Guide Strip
12. Deformed and shaped stainless steel plate coupled with a screw on both sides
13. Stainless steel plate coupled with a screw

14. Plug-type connecting head plate
15. Low friction slider pad
16. Screwed low friction slider hands
17. Low friction first bearing
18. Low friction second bearing
19. Horizontal plate

DETAILED DESCRIPTION OF THE EMBODIMENTS

The invention subject to the application is related to a hysteretic torsion damper that has been designed for cross frames. The torsional hysteretic damper comprises:

- one or more cylindrical energy dissipaters (ED) with extended tips (1),
- a torsion arm (2) connected with a plug-type connecting head plate (14),
- a support plate (3), which protects the energy dissipater against bending and which is welded to the base plate (8),
- a torsional restraint plate (4), which restricts the torsional movement at the distal ends of the cylindrical energy dissipaters (1) and which is connected to the base plate (8),
- rails (5) composed of two plates, that is connected to the connection plate (9),
- slider blocks having low friction slider pads (15) on two sides with each slider block being are coupled to the torsion arm (2) by means of a mounting shaft (7) and a second low friction bearing (18),
- cylindrical mounting shafts (7),
- a base plate (8) connected to the frame beam,
- a connection plate (9) that can shift laterally by means of guide strips (11),
- a cover plate (10) connected to the base plate (8),
- a torsional restraint plate (4) that is provided with guide strips (11) screwed to the cover plate (10) from the other side, so as to enable the connection plate (9) to move in the horizontal direction and to prevent inclinations of the supports in the plane,
- shaped stainless steel plates (12) that are found at the two sides of the connection plate (9),
- thin stainless steel plates (13) coupled to each plate of the rail (5) by means of screws,
- a plug-type connecting head plate (14) that connects the torsion arm (2) to the tip of energy dissipater (1),
- a low friction slider pad (15) that is a part of the slider block (6),
- screwed low friction slider bands (16) that is a piece of the guide strips (11),
- a first low friction bearing (17) placed at the connection points of the energy dissipater (1) and the support plate (3) in order for the energy dissipater (1) to perform low friction twisting,
- a second low friction Bearing (18) coupling the slider block (6),
- a horizontal plate (19) cross coupled, which transfers the damping force transversally, and
- a connection plate (9).

The purpose of the torsional hysteretic damper (1) is to translate the translational movement at the end points of the arms (2) into a twisting at the cylindrical energy dissipaters. (FIG. 1-6) The energy dissipater must not be bent while the translational motion is converted into twisting, so that the cylindrical energy dissipaters (1) yield smoothly over their constant-diameter region. The bending of the energy dissipaters (1) are prevented by means of the horizontal support plate (3).

Figure 3:
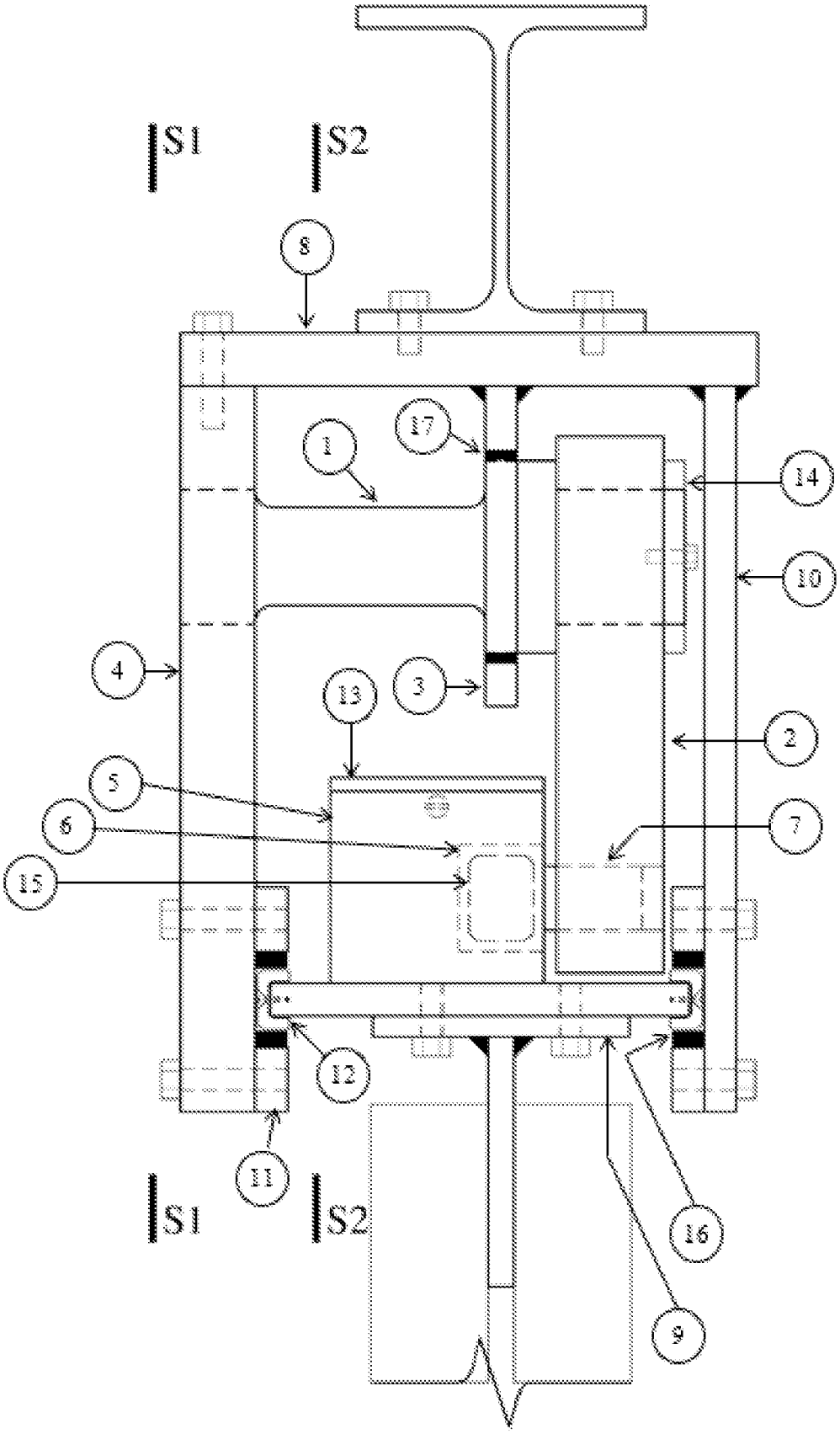
FIG. 3 is a side view (y-z plane) of the torsional hysteretic damper.
Figure 9:
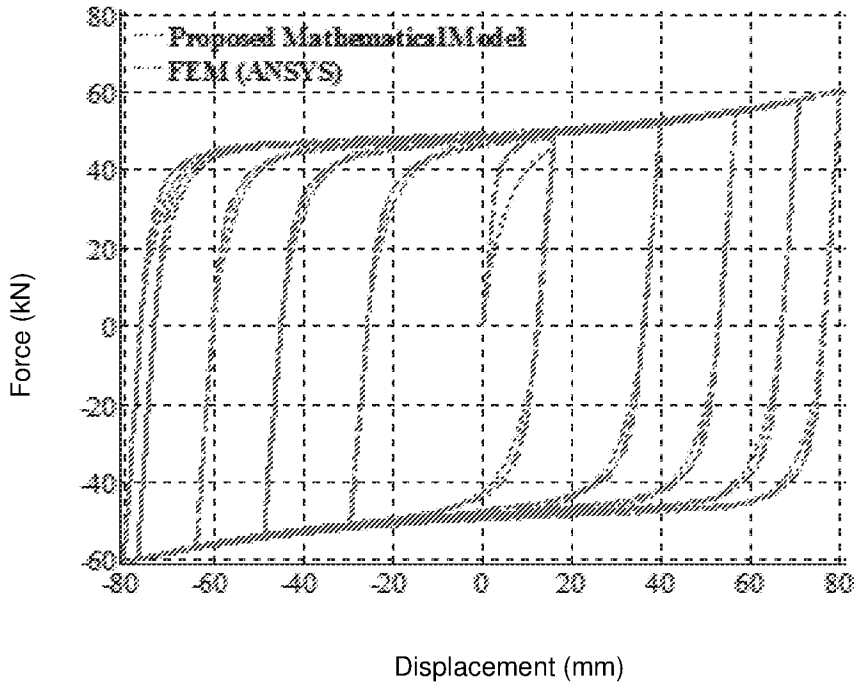
FIG. 9 is a diagram showing force-displacement curve of the frictionless torsional hysteretic damper under increasing circular shift.

FIG. 3 shows the side view (y-z plane) of the torsional hysteretic damper. The torsional hysteretic damper is constituted from 19 parts and these parts have been described in detail above. The support plate (3) is welded to the base plate (8). The base plate (8) is connected to the frame beam. Therefore, the support plate (3) receives the shear force from the energy dissipater (1) and transfers this force to the base plate (8). The shear force that has been transferred is the reaction force of the damper. The first low friction bearing (17) is mounted to the connection points of the energy dissipater (1) and the support plate (3) in order for the energy dissipater (1) to perform a low friction twisting. A slider block (6) is attached to the end of the arm (2) by means of the cylindrical mounting shaft (7). The slider block (6) that accommodates the slider pads (15) is made of steel and said block is in contact with the rail (5) by means of the low friction slider pads (15). The rail (5) is formed of two plates. Each plate of the rail (5) is provided with thin stainless steel plates (13) coupled to by means of screws. The aim of these plates (13) is to form a sliding interface for low friction. The rail (5) is connected to the connection plate (9). This plate (9) provides connection to the support. The connection plate (9) can shift laterally by means of guide strips (11). Thereby the bending of the supports is prevented. The slider block (6) and rail (5) or the connection plate (9) does not comprise a connection piece between them. The slider block (6) shown in FIG. 6 and FIG. 9, forms a roller-hinge type connection between the end points of the arm (2) and the rail (5) when it is brought together with guiding rails (5). The reason for requirement of such a connection is the vertical movement that is formed as a result of the rotation of the arm (2) between the rail (5) and the slider block (6).

Figure 2:
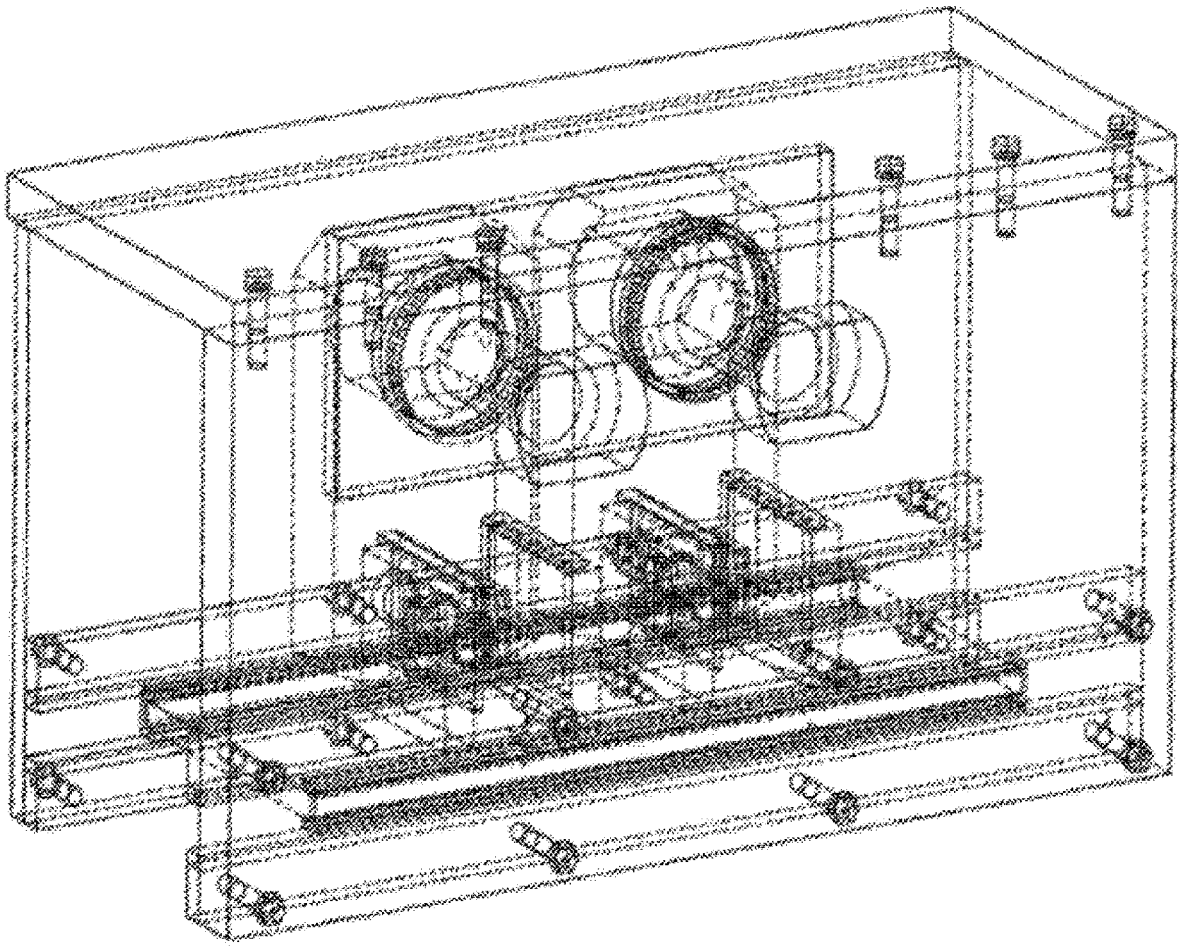
FIG. 2 is a perspective view of the torsional hysteretic damper.

As it has been mentioned above, the guide strips (11) enable the connection plate (9) to move laterally and prevent out-of-plane bending. The guide strips (11) are screwed on one side to the torsional restraint plate (4) and on the other side to the cover plate (10). Shaped stainless steel plates (12) screwed to the connection plate (9) that is in contact with the guide strips (11) via the low friction slider bands (16) have been provided to allow for low-friction sliding. connection plate. The torsional restraint plate (4) and the cover plate (10) that is shown in FIG. 2 and FIG. 3 are connected to the base plate (8). The torsional restraint plate (4) and the cover plate (10) receives the forces on the guide strips (11) and transfer these forces to the base plate (8) and then to the beam. The horizontal force (x-direction) applied from the arm (2) to the rail (5) and from the rail (5) to the connection plate (9) is called the damping force of the damper and this force is cross transferred by means of the horizontal plate (19); and the horizontal plate (19) is cross coupled.

Figure 4:
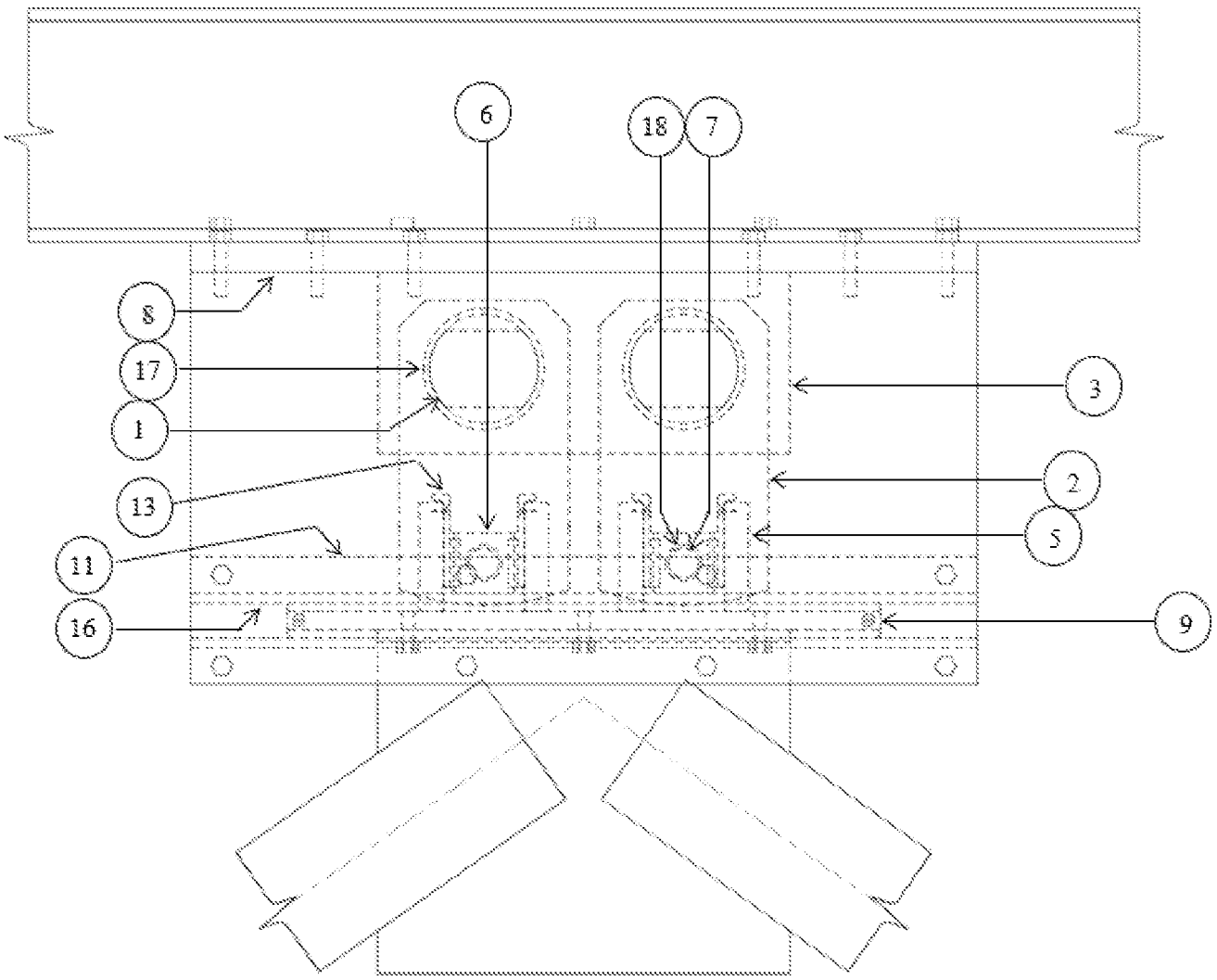
FIG. 4 is a front view (x-z plane) of the torsional hysteretic damper, namely the S1-S2 view of FIG. 3.
Figure 5:
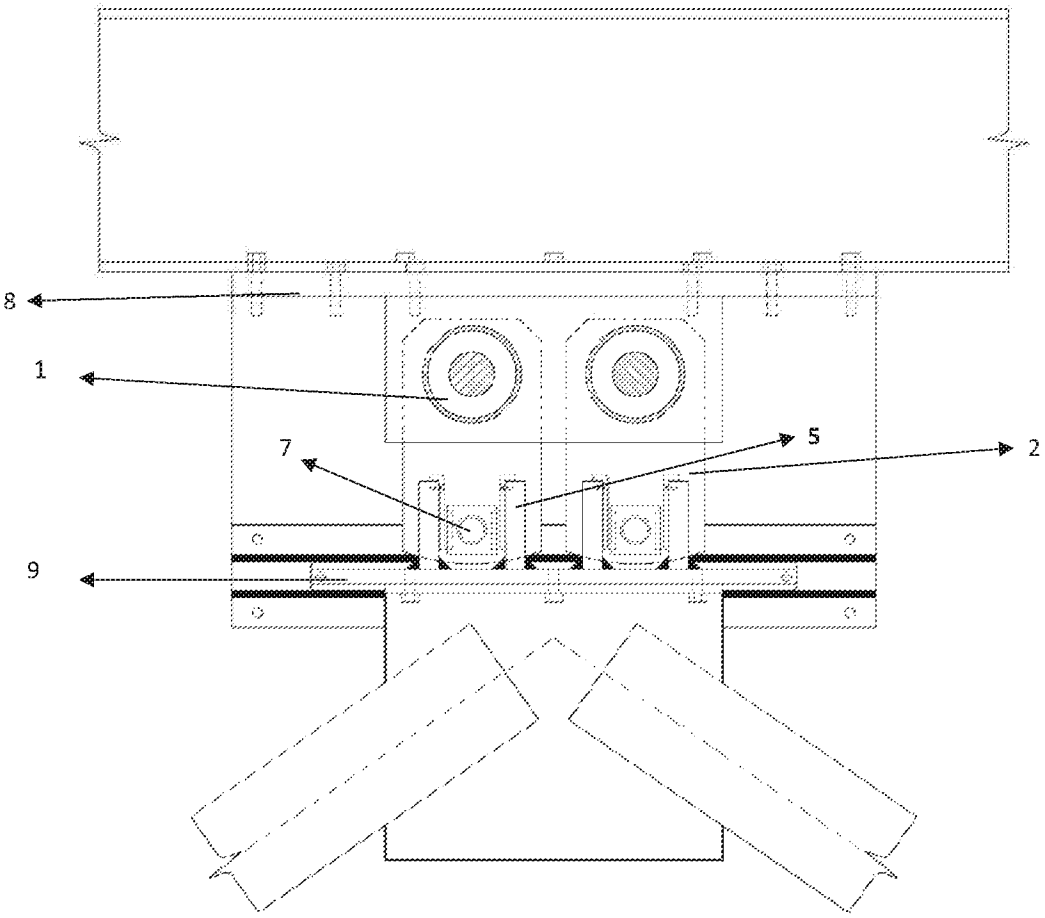
FIG. 5 is a S2-S2 view of FIG. 3 of the torsional hysteretic damper.
Figure 6:
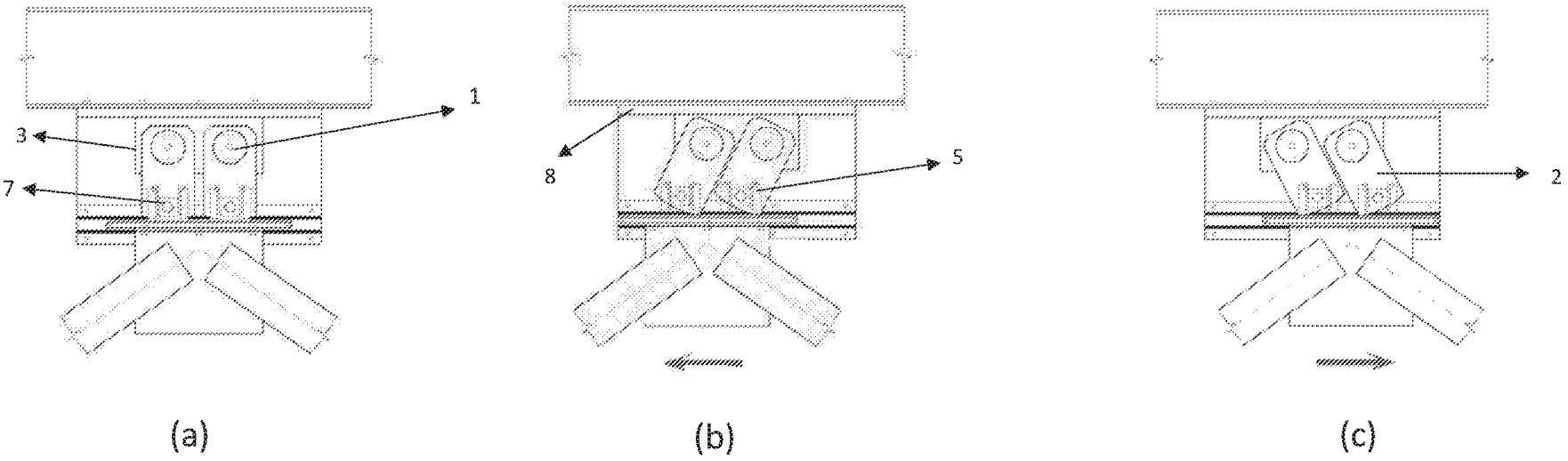
FIG. 6 is a schematic front view of the (a) torsional hysteretic damper in un-displaced condition and the (b), (c) torsional hysteretic damper in displaced condition.
Figure 7:
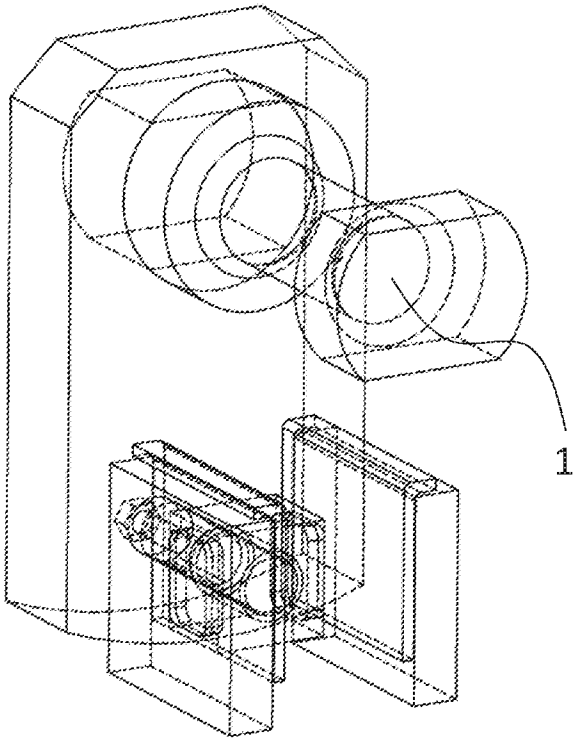
FIG. 7 is a diagram of an energy dissipation unit of the torsional hysteretic damper.
Figure 8:
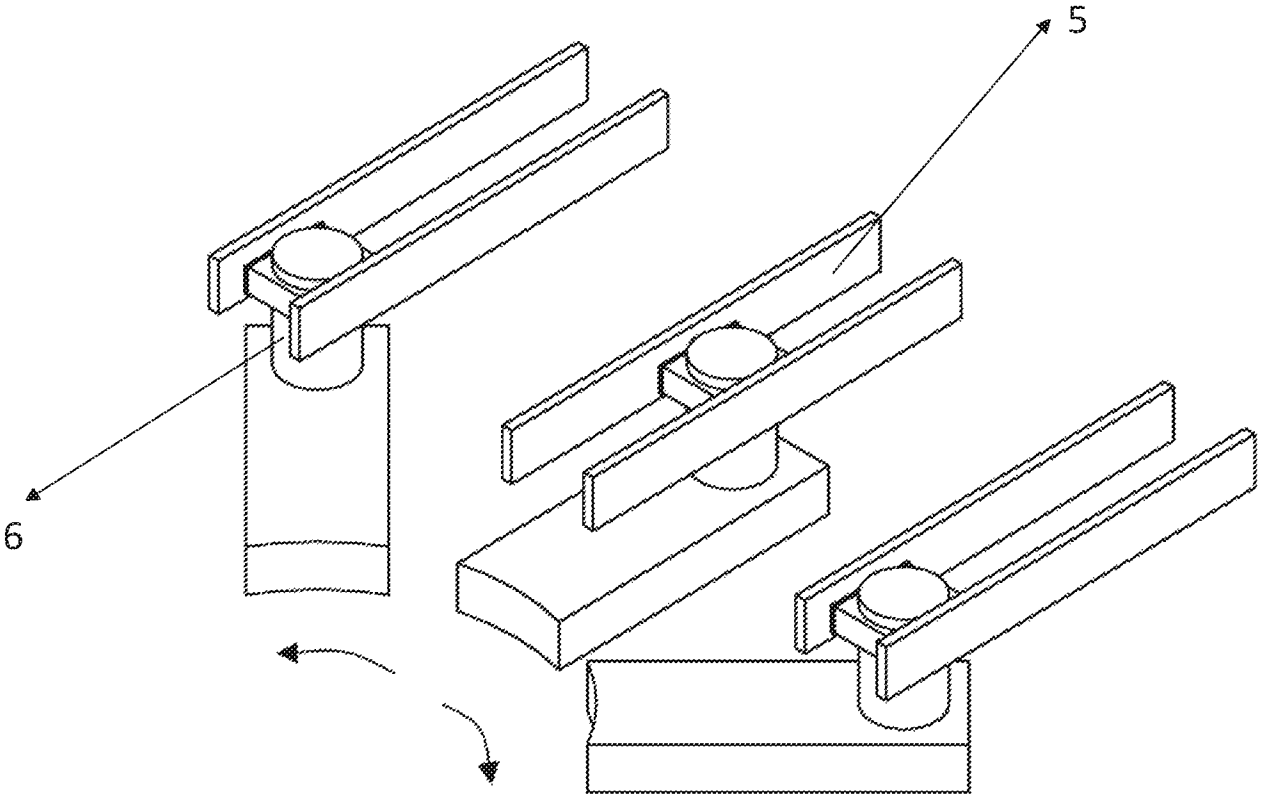
FIG. 8 is a diagram of a sliding and rotating mechanism of the slider block around the mounting shaft and inside the rail.

As shown in FIGS. 4 and 5, the torsional hysteretic damper may be formed of one or more energy dissipation units. A three dimensional view of the energy dissipation unit has been shown in FIG. 7. Each energy dissipation unit comprises:

- a cylindrical energy dissipater with extended tips (1),
- a torsion arm (2) connected with a plug-type connecting head plate (14), and
- a low friction, slider pad (15) sliding block (6).

In order to summarize, the torsional hysteretic damper has been designed to provide a hysteretic damping force via the rotation and yielding of the cylindrical energy dissipater (1)

due to the differential motion of the mounting points. The bending moments are transferred from the from the support to the frame beam.

What is claimed is:

1. A torsional hysteretic damper for braced frames, comprising at least one cylindrical energy dissipater (ED) with extended tips, at least one torsion arm connected with a connecting head plate as a plate to cover an opening or hole provided within such an arm, a support plate configured for protecting the cylindrical energy dissipater against bending, and wherein the support plate is welded to a base plate, a torsional restraint plate configured for restricting a torsional movement at distal ends of each cylindrical energy dissipater, and wherein the torsional restraint plate is connected to the base plate, at least one rail composed of two plates, and wherein the rail is connected to a connection plate, at least one slider block having slider pads on two sides with each slider block being coupled to the torsion arm by means of a cylindrical mounting shaft and a second bearing, and wherein the base plate is configured to be connected to a frame beam, the connection plate is configured to shift laterally by means of guide strips, a cover plate is connected to the base plate, both the torsional restraint plate and the cover plate comprise of separate guide strips attached thereto from one side, so as to enable the connection plate to move in a horizontal direction and to prevent bending of supports, shaped stainless steel plates are located at two sides of the connection plate, stainless steel plates are coupled to each plate of the rail by means of screws, the connecting head plate is connected to the torsion arm and to a tip of the cylindrical energy dissipater, slider bands are screwed to the guide strips, a first bearing is placed at connection points of the cylindrical energy dissipater and the support plate for facilitating the cylindrical energy dissipater to perform a twisting, a second low friction bearing is coupled to the slider block, and a horizontal plate is cross coupled to the connection plate.

2. The torsional hysteretic damper according to claim 1, wherein translational movements at end points of each torsion arm are converted into twisting movements at the cylindrical energy dissipater.

3. The torsional hysteretic damper according to claim 1, wherein the torsional hysteretic damper is configured to provide a hysteretic damping force via rotation and yielding of each cylindrical energy dissipater due to differential motions of two end points of the arm mounted respectively to the connection plate and the dissipater.

* * * * *